US005660134A

United States Patent [19]

Kim

[11] Patent Number: 5,660,134

[45] Date of Patent: Aug. 26, 1997

[54] AMPHIBIOUS VEHICLE COCOON

[76] Inventor: In Sik Kim, 59-29 Queens Blvd. Apt. 5L, Woodside, N.Y. 11377

[21] Appl. No.: 679,826

[22] Filed: Jul. 15, 1996

[51] Int. Cl.[6] ..... B63B 35/00

[52] U.S. Cl. ..... 114/270; 440/11; 293/117

[58] Field of Search ..... 440/11, 12, 113; 114/270, 361, 343; 293/117

[56] References Cited

U.S. PATENT DOCUMENTS

| | | | |
|---|---|---|---|
| 2,376,626 | 5/1945 | Schuller | 114/270 |
| 2,376,647 | 5/1945 | Akins | 114/270 |
| 2,497,857 | 2/1950 | Benson | 114/270 |

FOREIGN PATENT DOCUMENTS

| | | | |
|---|---|---|---|
| 1465679 | 12/1966 | France | 440/11 |
| 1127737 | 4/1962 | Germany | 440/11 |

*Primary Examiner*—Edwin L. Swinehart

[57] ABSTRACT

A thin, flexible, waterproof cocoon cover encloses the vehicle bottom, sides, front and back, may extend over the top of the vehicle, and buoys the vehicle up by displacement of water. Openings through the cover seal around the wheel support assembly and prevent entrance of the water through the cover to the brakes and other operational mechanisms of the vehicle.

5 Claims, 7 Drawing Sheets

Fig. 6
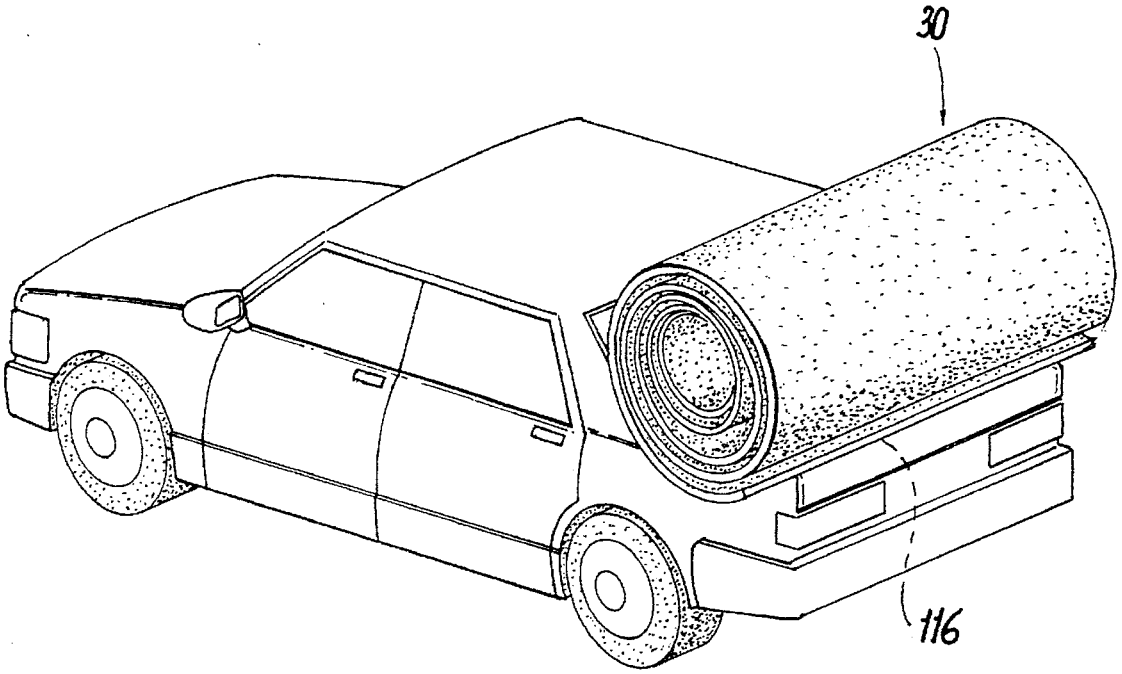
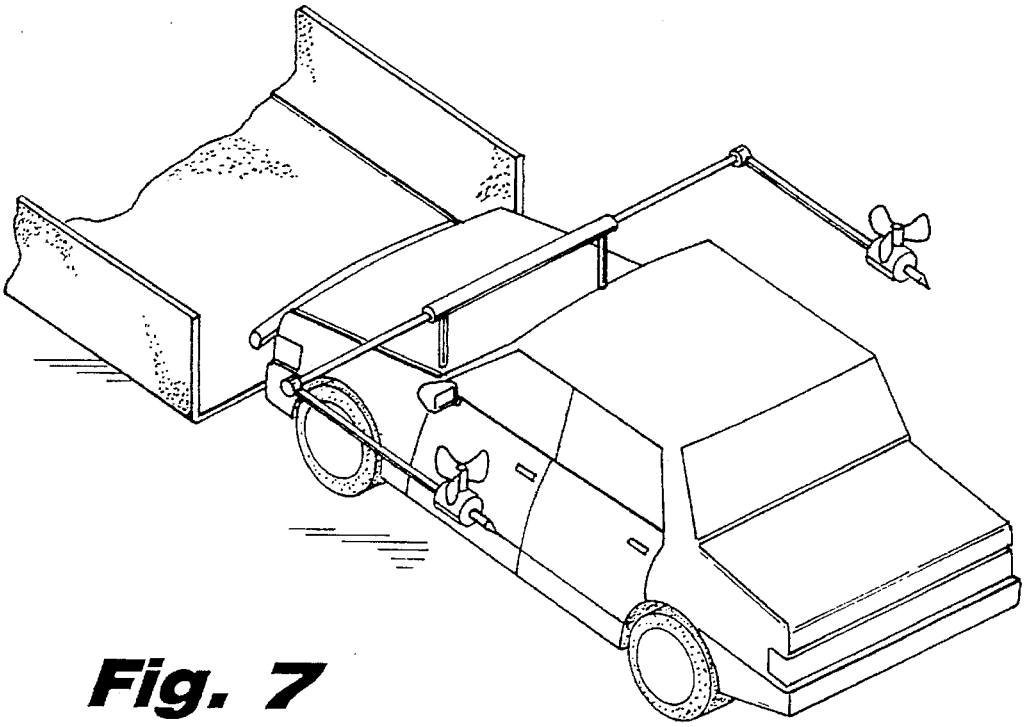
Fig. 7

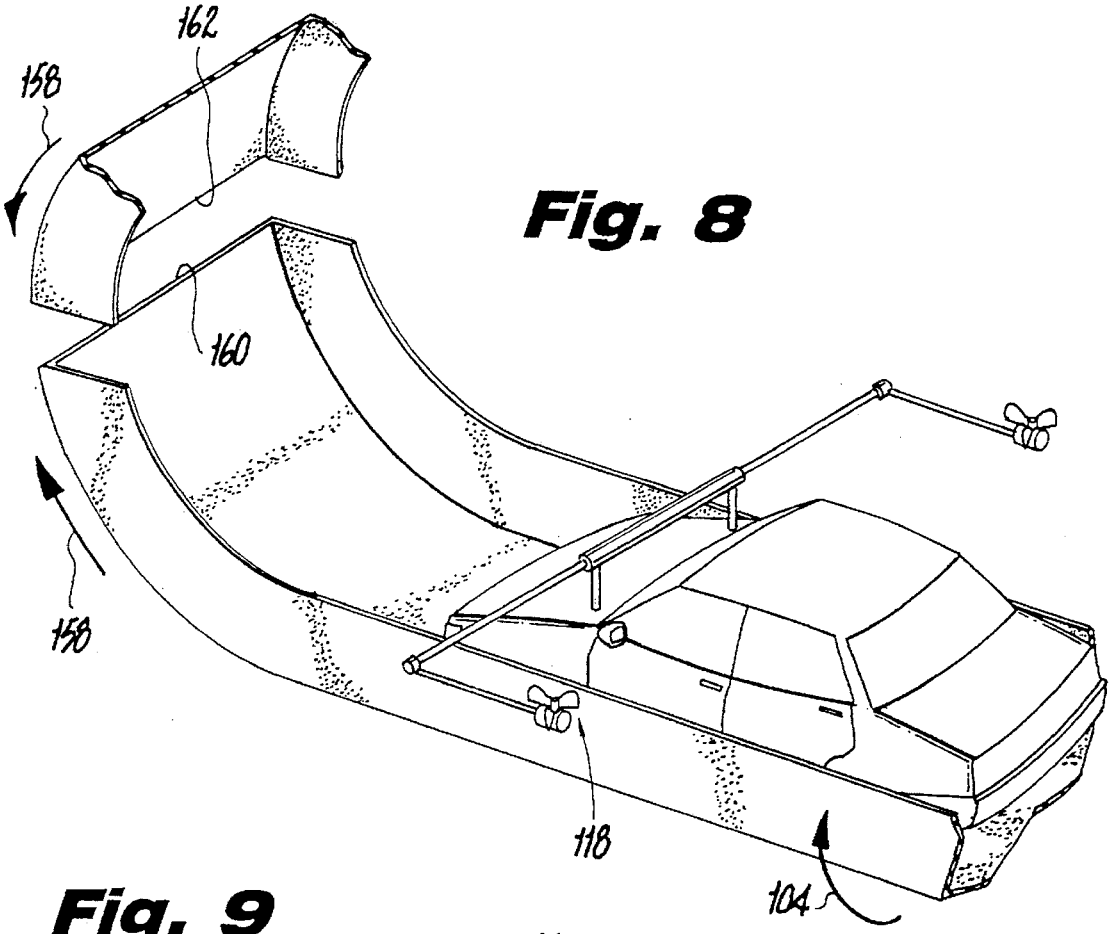
Fig. 8
Fig. 9
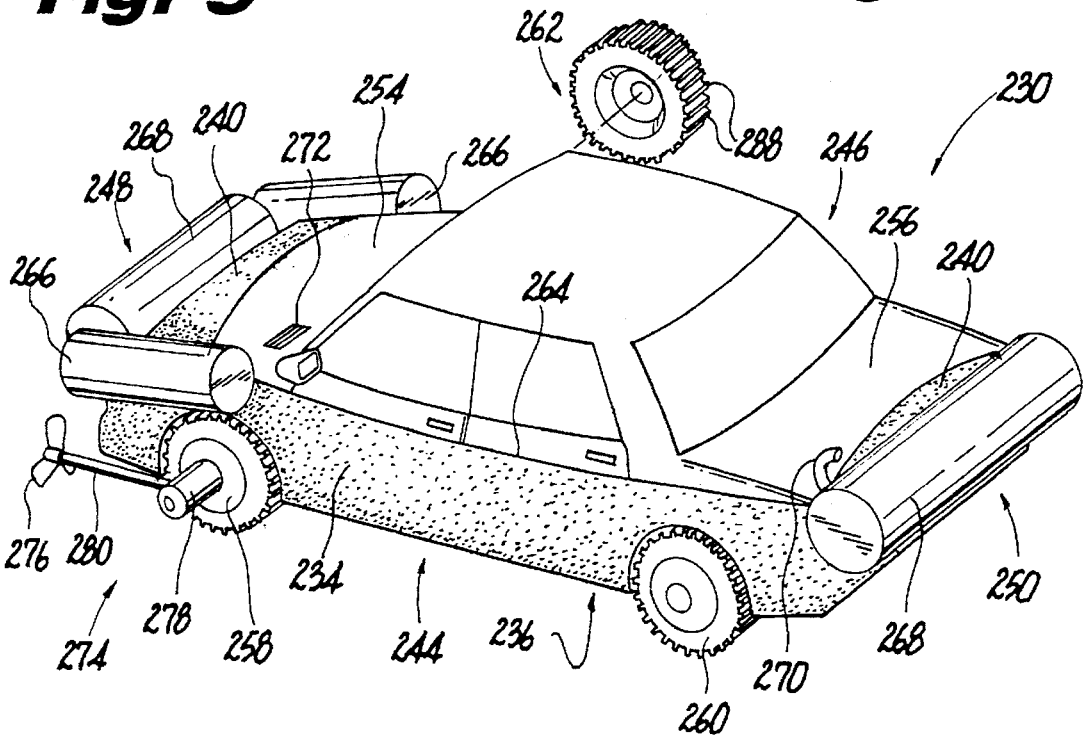

Fig. 10
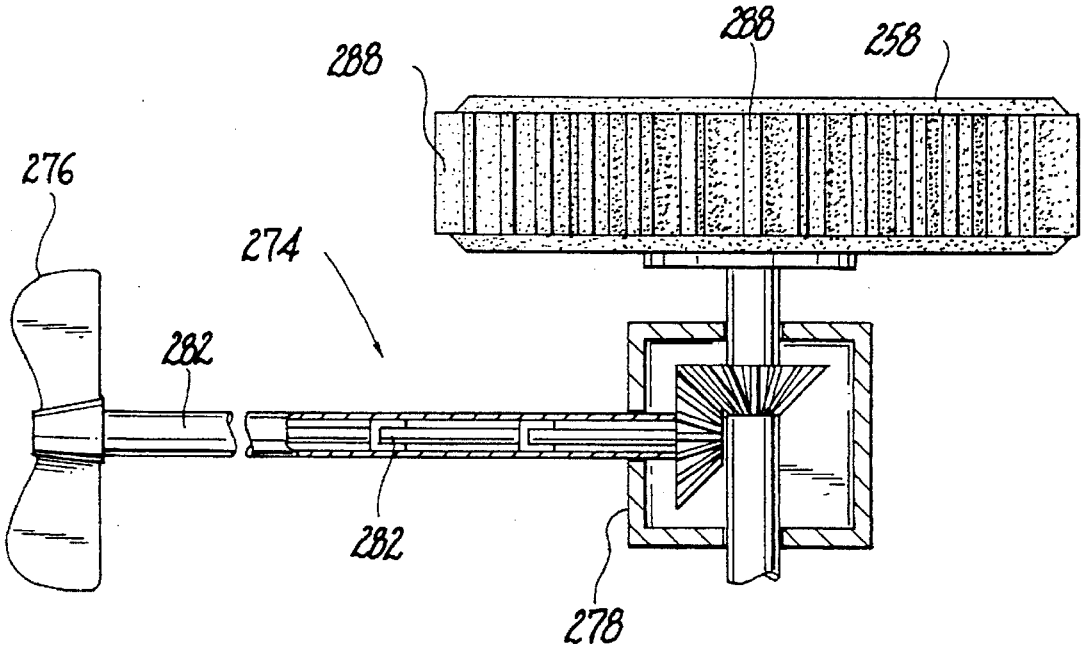
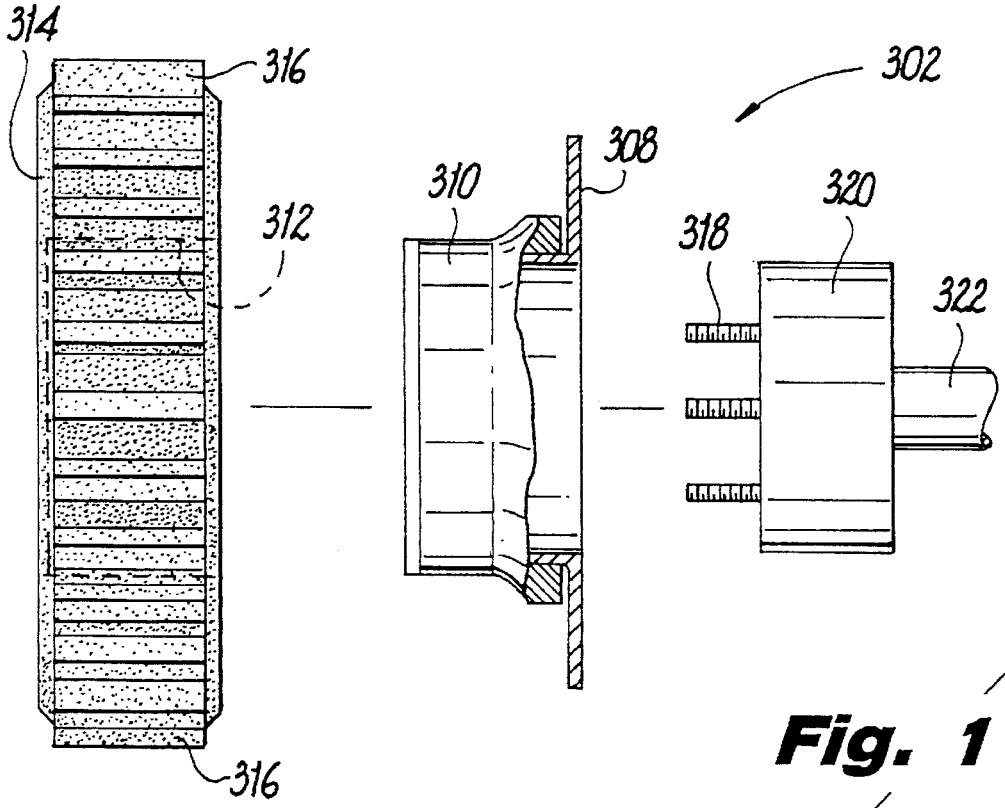
Fig. 11

AMPHIBIOUS VEHICLE COCOON

BACKGROUND OF THE INVENTION

1. Field of the Invention

The present invention relates to amphibious transport for motor vehicles, more specifically to a temporary enclosure which wraps about an automobile or similar land vehicle, which adapts the vehicle for travel on water under power provided by the vehicle's propulsion system. The device may be carried by the vehicle when the vehicle is operating on land, and is deployed about the vehicle for carrying the vehicle over the water.

2. Description of the Prior Art

The art is replete with patented apparatus for supporting a vehicle for movement on water under propulsion of the vehicle.

U.S. Pat. No. 1,568,307, patented by P. F. Acocella on Jan. 5, 1926, describes a barge having a hull of sufficient displacement to support the weight of an automobile. The hull has a deck and a plurality of rollers in the deck geared through a drive to a propeller which extends through the hull submerged below the stern of the barge. The rollers are placed so that the car can be driven onto the barge and onto the rollers for operating the propeller by rotating the drive wheels of the vehicle. Means is provided to lock the rollers against rotation so that the car can obtain sufficient traction to move off the rollers. A pair of turntables attached to a rudder by bell cranks and rudder lines, receive the steering wheels of the vehicle for operating the rudder by turning the steering wheels.

U.S. Pat. No. 2,979,016, patented Apr. 11, 1961 by S. J. Rossi, describes attaching buoyant wheels on axial extensions, to the wheels of the vehicle. The buoyant wheels have a buoyancy sufficient to float the vehicle to which they are attached. Flat radial plates on the buoyant wheels provide steering by acting as rudders on the steerable wheels of the vehicle. A plurality of U-shaped clamps aid in securing the buoyant wheels to the vehicle wheels which are primarily attached to the vehicle wheels by the vehicle's wheel bolts. The buoyant wheels include paddle means for propelling the vehicle over the water. Optionally, an auxiliary buoyant float platform having horizontally extending wings in outrigger fashion is provided.

U.S. Pat. No. 3,011,184, patented by L. A. Curcio on Dec. 5, 1961, describes an outer ring of buoyant material, such as an inflatable casing, surrounding a generally rectangular and flat floor of buoyant material. The combination of outer ring and floor form a raft having sufficient buoyancy to support a vehicle. The floor has holes through which the wheels of the vehicle extend into the water when the bottom of the vehicle frame is supported by the floor. The wheels propel the raft by rotating in the water. For improved thrust, each wheel may be fitted with a rubber or plastic belt having a plurality of parallel transverse ridges. The vehicle is loaded onto the raft by driving it over the casing and floor while they are deflated and flat. In another embodiment, one side of the outer ring is detachably fastened together so that it can be spread apart in order to permit the vehicle to drive through onto the inflated raft.

U.S. Pat. No. 3,213,821, patented Oct. 26, 1965 by V. R. Godwin, describes a land vehicle that is converted to be driven on water by attachment of elongated concave shells to the sides of the vehicle body so that they form catamaran pontoons by capturing air against the body of the vehicle. The shells enclose the front wheels of the vehicle and present a streamlined front end for the vehicle. The rear road wheels of the vehicle are removed from the brake drums and replaced with paddle wheels which are bolted on the brake drums. The pontoons support the body of the vehicle so that the rear wheels extend into the water for thrusting the vehicle over the water. A propeller mounted rearward through the each concave shell may be provided, driven by attachment to the brake drum. Steering is by a rearward mounted rudder, connected by belt and pulleys to the steering wheel shaft for operation by the steering wheel shaft.

SUMMARY OF THE INVENTION

It is one object to provide amphibious transport for a land motor vehicle.

It is one object of the invention to provide an apparatus for amphibious conversion of a land motor vehicle.

It is another object that the vehicle can carry the apparatus when the vehicle is on land.

It is another object that the apparatus converts the vehicle without having to disassemble the vehicle.

It is another object that the amphibious converted vehicle is able to move over the water under power from the vehicle's engine.

It is another object that the vehicle remains dry when operating over water in the amphibious state.

It is another object that the apparatus comprises a relatively light weight, thin, flexible, waterproof cover, and hydrodynamic thrust means operable by the vehicle's drive train.

Other objects and advantages of the invention will become apparent to persons skilled in the art from the ensuing description.

A thin, flexible, waterproof, strong cover has an area that is large enough to surround the vehicle body entirely over the bottom end, and upward on the first side, second side, the first end, and the second end of the body.

Openings are provided in the cover for passage of wheel mounting means through the cover. In one embodiment of the invention, seal means is mounted on the cover so that the seal means seals with the wheel mounting means against passage of liquid through the cover at the wheel mounting means, and prevents passage of liquid through the cover to brake means of the vehicle. Preferably the seal means is a water tight rotary seal, and may comprise a seal wall on the brake drum.

A wheel of the vehicle includes water propulsion means connected to the wheel for receiving operational power from the wheel. The water propulsion means may include extended surface portions on the wheel, adapted for generating thrust when the first wheel is rotating in the water.

The water propulsion means may include hydrodynamic thrust means connected to power transmission means connected to the wheel for delivering rotary power from the wheel to the hydrodynamic rotary thrust means. The power transmission means may pass over the cover.

Preferably the cover is between the hydrodynamic thrust means and the body when the cover is upward on the side of the body.

The hydrodynamic thrust means may be a propeller on a shaft which can be moved generally vertically and tilted generally horizontally, and is mounted on the vehicle by means comprising a bevel gear.

The cover is movable vertically between the top and the bottom of the body when the vehicle is mounted on the cover, a first portion of the cover being movable to a position on the top of the vehicle. Separable, water tight sealing, fastening means are on the first portion for holding the first portion on the top of the vehicle. The first portion forms a cocoon enclosure over the top of the vehicle.

Free-wheeling support means is mounted on the cover for directly supporting the wheel.

In one embodiment the cover closely fits the vehicle and is movable to form an elongated margin attached to the vehicle along the bottom of the body.

BRIEF DESCRIPTION OF THE DRAWINGS

In order that the invention be more fully comprehended, it will now be described, by way of example, with reference to the accompanying drawings, in which:

FIG. 6 is a perspective view of the vehicle carrying the invention prior to installation of the invention on the vehicle.

FIG. 7 is a perspective view of the invention partially deployed for installation on the vehicle.

FIG. 8 is a perspective view of the invention partially deployed and partially installed on the vehicle.

FIG. 9 is a perspective view of the invention in another embodiment, installed on a vehicle and adjusted for amphibious operation.

FIG. 10 is a schematic view of a power transmission and hydrodynamic thrust means deployment assembly of the invention.

FIG. 11 is a schematic view of a seal assembly of the invention.

DESCRIPTION OF THE PREFERRED EMBODIMENTS

Figure 1:
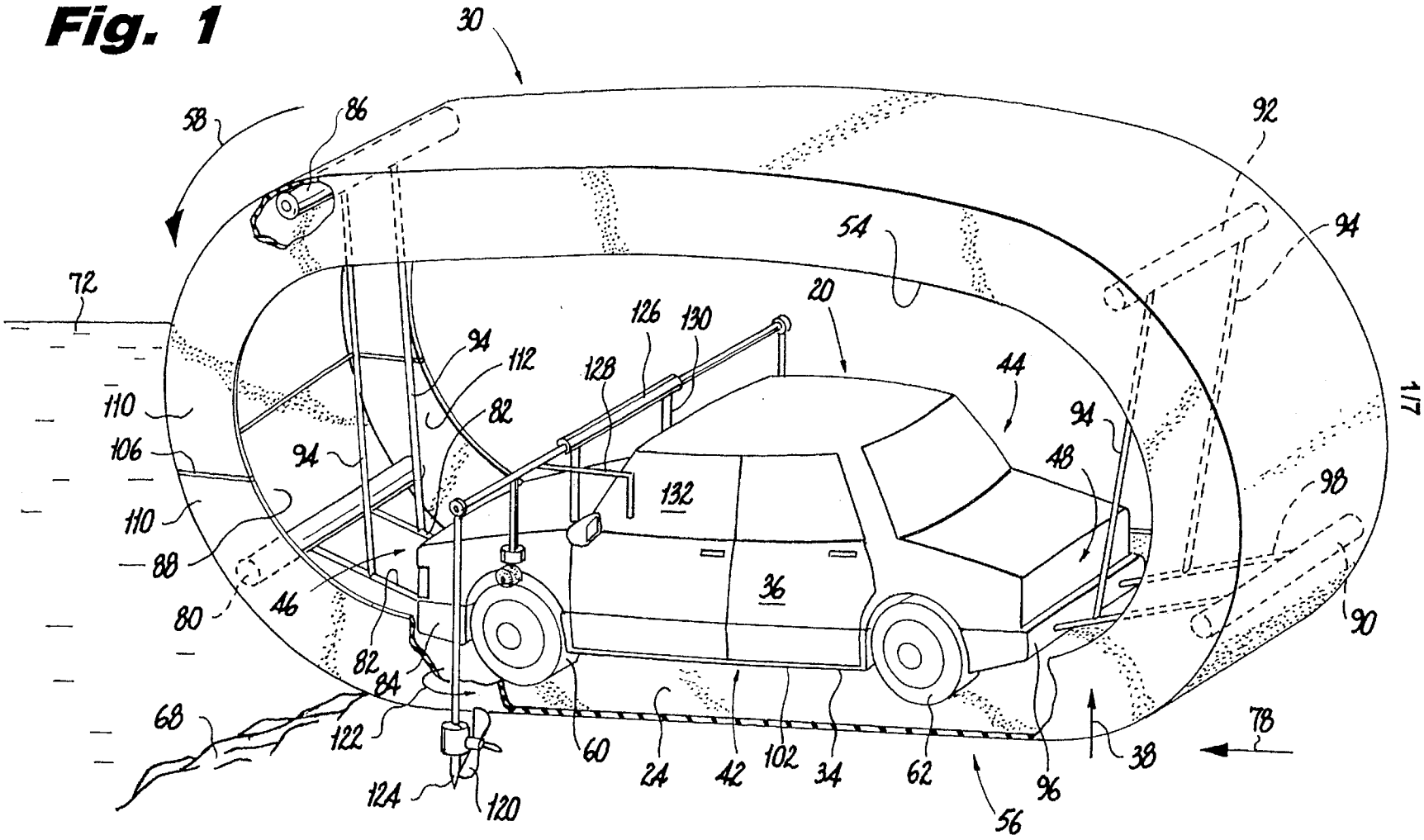
FIG. 1 is a perspective view of the invention installed on a vehicle.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
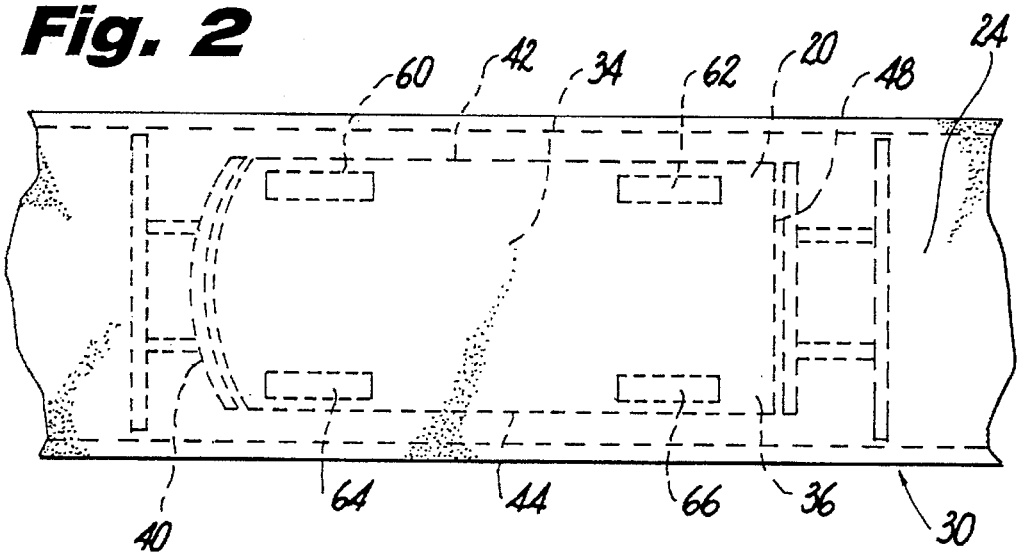
FIG. 2 is a bottom view of the invention and vehicle of FIG. 1 showing the bottom of the vehicle in the cocoon.
Figure 3:
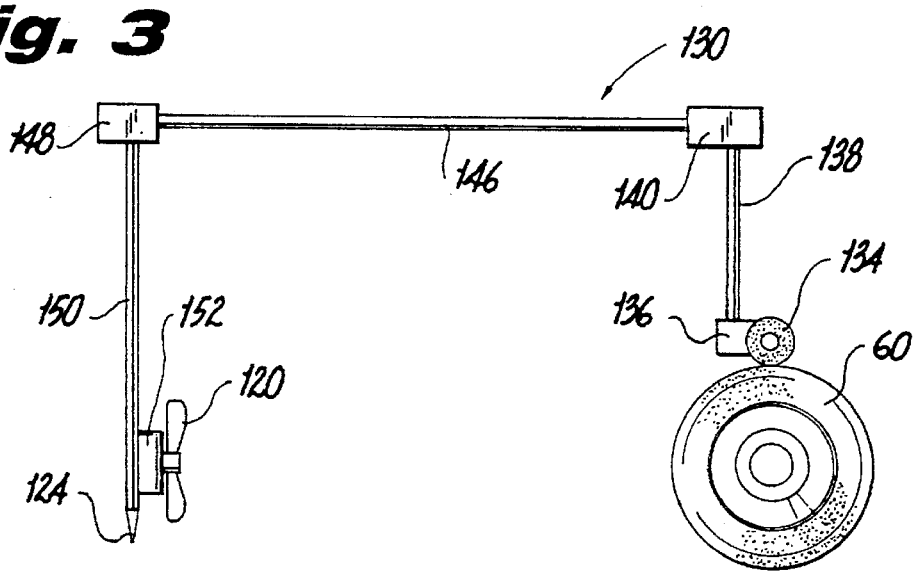
FIG. 3 is a schematic view of a power transmission assembly of the invention.

Referring to FIGS. 1, 2, and 3, vehicle 20 is mounted on floor 24 of cover 30. Cover 30 is thin, flexible, and preferably made of a strong waterproof material such as a fiber reinforced elastomer, or reinforced plastic or rubber. The cover has sufficient area to form a cocoon 54 that covers bottom 34 of the vehicle, and surrounds body 36 of the vehicle and extends upward 38 on sides 42, 44, front 46 and back 48 of the body 36, and extends over the top of the vehicle.

A portion of the cocoon is cut away at 56 to show the propulsion mechanism for operation on land and on water when the vehicle is in the cocoon.

Vehicle 20 is designed for operation on land by running over the land on wheels 60, 62, 64, and 66. Indeed this is the most practical way to move vehicle 20 over land.

Converting of vehicle 20 to an amphibious vehicle by mounting the vehicle on cover 30 is more easily done on land 68 as will be explained later. This is preferably done immediately adjacent to the water 72 into which the converted vehicle will be introduced. This is because as a result of the conversion, the vehicle's wheels are enclosed in cocoon 54 and cannot obtain direct traction with the ground. The cocoon and enclosed vehicle are therefore moved the short distance to the water under the vehicle's own power by rolling 58 the cocoon across the land into the water.

As vehicle 20 is driven forward 78, front roller 80 mounted on extension bracket 82 of front bumper 84, presses against upcurving portion 88 of floor 24. This pushes the cocoon forward from the inside, and vehicle 20 moves forward over the floor as the cocoon rolls forward 58 and the floor moves down in front of the vehicle. This continues until the cocoon is in the water.

Front roller 80 and extension bracket 82 form a low-friction guide and support means that supports the shape of the cocoon adjacent to the vehicle against water pressure and gravity which press cover 30 toward collapse of the cocoon toward the vehicle in the cocoon. Other low-friction guide and support means for this purpose may include a fixed (non-rotatable) bar coated with a low-friction material such as TEFLON® mounted on bracket 94; and a bumper coated with TEFLON®, mounted on the vehicle so that it engages the cocoon cover to support the shape of the cocoon adjacent to the vehicle.

Preferably the cocoon material is stiff enough to maintain the upper curve over the vehicle without assistance. If a use of a less stiff material is desired, top rollers 86 and 92, supported by front and back vertical brackets 94 or another low-friction guide and support means such as TEFLON® guide bars high on the vehicle provide the support.

Propeller 120 provides hydrodynamic thrust when the cocoon is in water. Spike 124 on propeller mount rack 126 is available for dragging on the land to turn the moving cocoon if necessary.

The cover should be lined up carefully with the direction it is to be moved before the cocoon is assembled in order to avoid need for use of the spike.

Rack 126 can be tilted 122 so that spike 124 is brought to bear on the land so as to obtain drag. When the cocoon is in water, rack 126 can be tilted to select a desired angle of attack of the propeller in the water.

Handle 128 provides a simple way to control the tilt. Handle 128 extends from rack 126 to the driver's window 132 of the vehicle so that the driver can tilt the rack by moving the handle. A mechanical advantage linkage can be built into the handle so that the driver can apply the spike to the land effectively, without unpleasant physical strain by the driver.

Propeller mount rack 126 also includes power transmission means 130 connected to wheel 60 for delivering rotary power from the wheel to the propeller.

Power transmission means 130 includes power pick-up wheel 134 riding on vehicle wheel 60, connected to bevel gear 136, power transmission shaft 138, bevel gear 140, power transmission shaft 146, bevel gear 148, power transmission shaft 150, and bevel gear 152 which is connected to propeller 120. By reducing the number and severity of angles, universal joints may replace bevel gears.

In another power transmission means, power pick-up wheel 134 may be connected to a hydraulic pump which pumps fluid through a hydraulic line that is attached to rack 126 and that is connected to a hydraulic motor that directly drives propeller 120.

Once in the water, the flexible cocoon is forced upward about the vehicle by the force of the displaced water. Sufficient stiffness or body is provided in the cover so that the wheels, and low-friction support and guide means such as front roller 80 and rear roller 90 in contact with upsurging floor 24 support the car on floor 24.

Extension bracket 82 and extension bracket 98 which attaches rear roller 90 to rear bumper 96 may also be mounted so that they are generally planar with bottom 102 of body 36, so that they also are partially engaged by the upsurging floor and contribute to support of the vehicle in the water after it settles into the water.

More portable low-friction guide and support means such as a TEFLON® bumper shaped to engage, guide, and support the cocoon floor adjacent the vehicle may be used.

Preferably, in order to avoid drag and damage of the floor, the bottom of the body and standard bumpers are not contacted by the floor which is moving relative to the body while the cocoon is rolling.

Cover 30 extends over vehicle 20 and is joined to itself in water tight seal 106 across the floor and sides 110 and 112 of cocoon 54. The seal is made by separable fastening means such as, for example, VELCRO® or other separable fastener, augmented by a continuous plastic zipper flap such as the kind used on freezer bags, or other continuous separable seal known to the sealing art.

Figure 5:
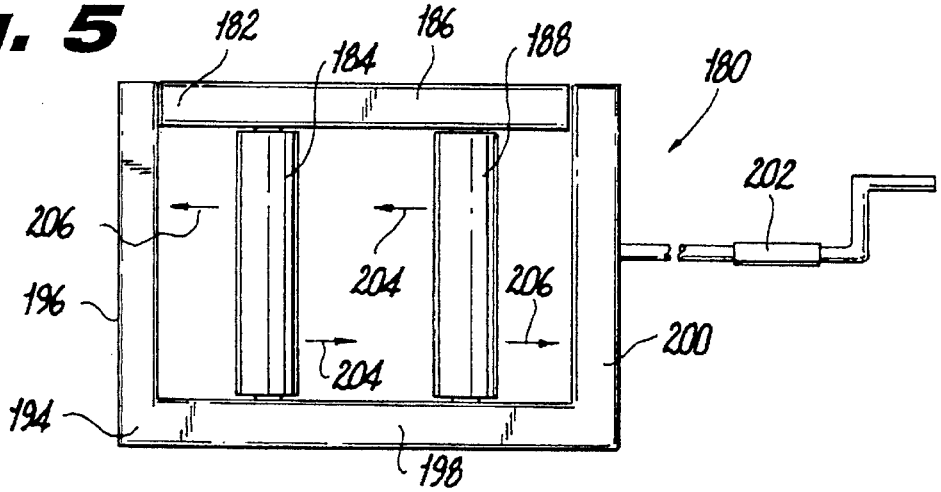
FIG. 5 is a schematic view of a free wheel support of the invention.
Figure 4:
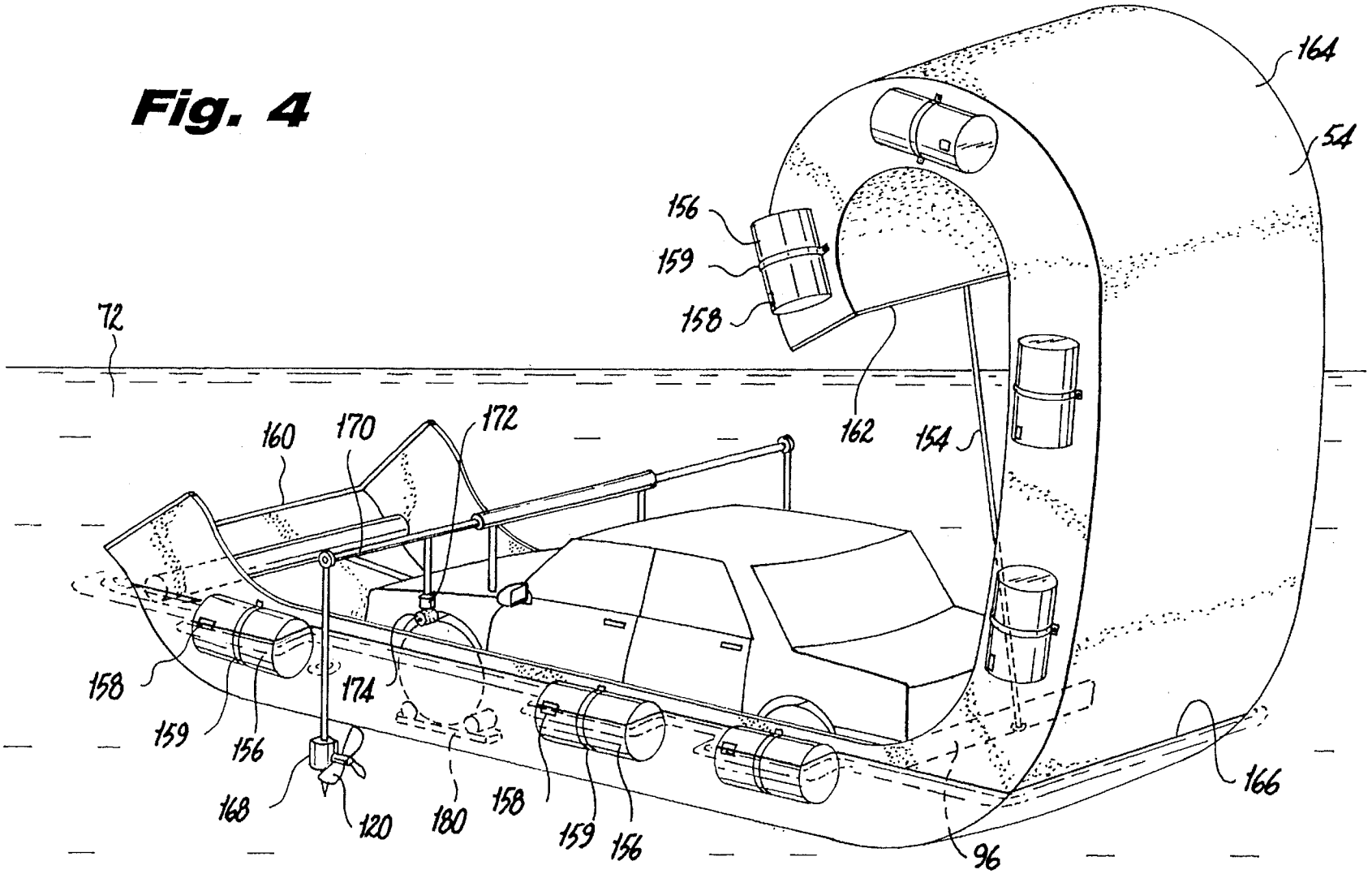
FIG. 4 is a perspective view of the invention installed on a vehicle.
Figure 12:
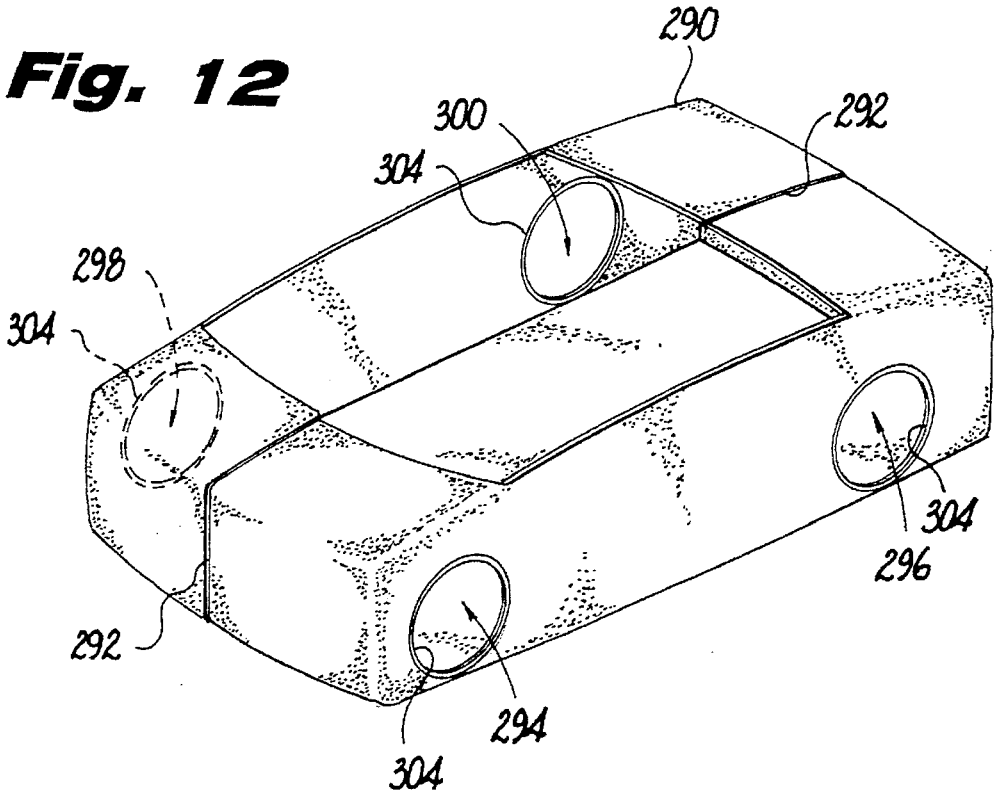
FIG. 12 is a perspective view of a cover of the invention.

Turning to FIGS. 4 and 5, seal ends 160 and 162 of the watertight seal are detached from one another, and end 164 is drawn back. This provides clear forward and side views for the driver as the cocoon is propelled over the water by propeller 120.

Depending upon the stiffness of the cover, end 164 of the cover can be rolled down to just above water line 166 and attached by a chain, rope, bar or other draw-down means 154 to the back bumper 96 so that a clear rear view is provided to the driver.

Flotation pods 156 may be added to the sides 110 of cocoon 54 for additional buoyancy beyond that provided by the water displacement of the cocoon. Pods 110 may contain permanent flotation material such as styrofoam. The pods may contain bladders which are filled with gas. As a safety precaution against puncture of a wall or floor of the cocoon, or failure of a seal, the bladder may automatically fill with gas in response to tripping of depth sensor 158 by water pressure. The flotation pod may have any shape, for example one or a plurality of long tubes, and may be rigid or flexible, preferably so long as it does not prevent movement of the cover.

Propeller 120 is rotated by hydraulic motor 168 which receives hydraulic fluid by way of hydraulic pipe line 170 from hydraulic pump 172. Hydraulic pump 172 is driven by power pick-up wheel 174 that takes rotational power from vehicle wheel 60.

In order to take rotary power from the powered wheels of the vehicle, wheels 60 and 62, the wheels are separated from floor 24 by free wheel support assembly 180.

Two of the free wheel support assemblies are used, one on each wheel. For example, assembly 180 is installed on wheel 60 by slipping U-shaped subassembly 182 comprising roller 184, roller support bar 186 and roller 188 around the wheel, then attaching U-shaped sub assembly 194 comprising brace bar 196, roller support bar 198, and controller brace bar 200, to sub assembly 182. Hand crank 202 is turned to drive the rollers together 204, or draw them apart 206. When the rollers are driven together they lift wheel 60 from floor 24 and allow the wheel to rotate without frictional contact with the floor, and transfer almost all of its rotational power to power pick-up wheel 174.

In FIG. 6, cover 30 is transported rolled up on the rear deck 116 of the vehicle.

In FIG. 7, cover 30 is unrolled and laid flat, and the vehicle is driven onto the cover. Propeller shaft 118 is moved from a horizontal to a vertical position 104.

In FIG. 8, seal end 162 is brought toward 158 seal end 160 for fastening to form the cocoon of FIG. 1.

In FIGS. 9 and 10, in another embodiment of the invention, vehicle 230 is converted to an amphibious vehicle. Cover 234 has sufficient surface area to form cocoon 240 that covers bottom 236 of the vehicle, and surrounds body 238 of the vehicle and extends upward on sides 244, 246, front 248, and back 250 of the body, and extends over the top of the vehicle's hood 254 and trunk 256.

Cover 234 is made of a waterproof material. It is strong, preferably thin, flexible, and made of a reinforced elastomer such as fiberglass reinforced rubber or plastic. Preferably, the cover closely fits the vehicle. The cover keeps water out of the passenger compartment and critical moving parts of the vehicle when the vehicle is in water. Preferably, the cover closely fits the vehicle.

Vehicle 230 is designed for operation on land by running over the land on wheels, three of which are showing, 258, 260, and 262.

In water, buoyancy is provided by the volume of water that is displaced by cocoon 240 extended over vehicle 230. If the volume displaced is not large enough to float the vehicle high enough so the upper margin 264 of the cover is above the water line, additional flotation may be provided by inflatable tubes 266 at the front of the vehicle, and inflatable tubes 268 at the front and back of the vehicle.

Exhaust pipe 270 extends above upper margin 264, and is turned downward with the opening above upper margin 264 to keep water from running down to the muffler.

Fresh air supply for the engine is taken through opening 272 in the hood.

Propeller 276 provides hydrodynamic thrust propulsion when the cocoon is in the water. Propeller 276 is connected to front drive wheel 258 by power transmission means 274 which includes bevel gear 278, propeller shaft 280, and two universal joints 282. The universal joints permit changing the angle of attack of the propeller in the water. It should be clear that removing the rubber tire does not change the intent and meaning of propeller 276 being connected to the front drive wheel for obtaining power therefrom.

Another hydrodynamic thrust propulsion option which may be used with a propeller, or instead of a propeller, is extended surface portions 288 which are ridges that may extend radially or axially from the outer portion of wheel 260 so that they generate thrust when the wheel rotates in the water. This wheel has the advantage of drawing the vehicle along on land and water.

Referring to PIGS. 11 and 12, cover 290 has removable fastening means 292 which seal liquid tight when closed, and may be unfastened so that the cover can be installed on a vehicle.

Openings 294, 296, 298, and 300 are provided for extension of wheel mounting means 302 at each opening. Seal ring 304 at each opening seals with wheel mounting means 302 so that water cannot enter through the cover at the wheel mounting means.

Wheel mounting means 302 has metal seal rim 308 which mates with seal 304 to effect the watertight seal. Preferably seal 308 is mounted on brake drum protective housing 310 or some other element between wheel 312 and the brake and bearing system of the wheel mounting means so that water is prevented by the seal from entering the brake or bearing systems.

Rubber tire 314 having hydrodynamic protuberances 316 to provide thrust in water and traction on rough terrain and sand is attached by bolts 318 to brake drum 320 of axle 322 of the vehicle.

Figure 13:
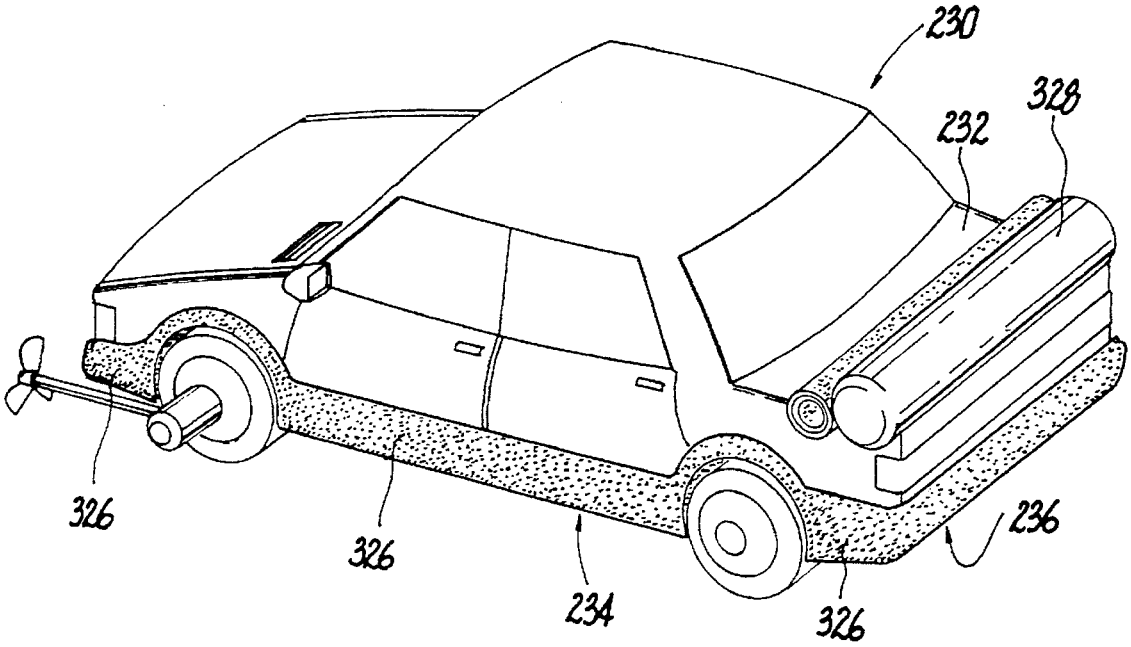
FIG. 13 is a perspective view of the vehicle in FIG. 9, with the invention adjusted for travel over land.

In FIG. 13, cover 234 is pulled down on vehicle 230 from the top 232 to bottom 236 of the vehicle where it is rolled into an elongated margin 326. A portion of the cover may be stored in bumper 328. The vehicle then reverts to being a land vehicle.

The cover remains down, ready to be lifted on the front, back and sides of the car if rapid change to a combination water and land vehicle is desired.

If a removable fastener/seal is included to ease movement and wrapping of the cover on the vehicle, it is opened before the cover is lowered.

Cover material, however, may be used without a removable fastener/seal. The cover is provided with sufficient elasticity to pull it up whereby it clings to the vehicle, and to draw it from the car and pull it down.

With the cover rolled down, doors of the vehicle are easily opened. For convenience and rapid deployment of the cover, the seals between the wheel mounting assemblies of the vehicle and the cover openings for passage of the wheel mounting assemblies, remain in place.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. An amphibious vehicle comprising:

a body having a top, a bottom, a first end, a second end, a first side, a second side, a plurality of wheels on said body extending below the bottom of said body, wheel mounting means for receiving each wheel of said plurality of wheels, brake means mounted on said wheel mounting means, a bumper mounted on said body, and a motor for rotating said wheels, a cover, said cover being thin, flexible, made of a waterproof material, and having an area that is sufficiently large enough to surround said body entirely over the bottom end, and upward on the first side, the second side, the first end and the second end, a first wheel of said plurality of wheels comprising water propulsion means connected to said first wheel for receiving operational power from said first wheel, said cover being movable vertically between the top and the bottom of said body when said body is mounted on said cover, a first portion of said cover being movable to a position on the top of said body when said body is mounted on said cover, said first portion forming a cocoon enclosure over the top of said body at the front end of said body, said bumper containing a portion of said cover.

2. The apparatus of claim 1, further comprising:

openings in said cover for passage of said wheel mounting means through said cover.

3. The apparatus of claim 2 , further comprising:

seal means mounted on said cover so that said seal means seals with said wheel mounting means against passage of liquid through said cover at said openings.

4. The apparatus of claim 3, further comprising:

said seal means sealing with said wheel mounting means against passage of liquid through said cover to said brake means.

5. The apparatus of claim 4, further comprising:

said brake means comprising a brake drum, said seal means being a watertight rotary seal adapted for engaging a seal wall on said brake drum.

* * * * *